United States Patent [19]

Vaughan

[11] 4,072,238

[45] Feb. 7, 1978

[54] SELF-UNLOADING SHIP WITH TWO TUNNEL BELTS AND A CENTRAL RECLAIMER

[75] Inventor: Warren R. Vaughan, Belleville, Canada

[73] Assignee: Allis-Chalmers Corporation, Milwaukee, Wis.

[21] Appl. No.: 744,516

[22] Filed: Nov. 24, 1976

[51] Int. Cl.[2] ..... B63B 27/22

[52] U.S. Cl. ..... 214/15 E; 198/669; 214/10; 214/16 R

[58] Field of Search ..... 198/669; 214/12, 13, 214/14, 15 R, 15 D, 15 E, 16 R, 10

[56] References Cited

U.S. PATENT DOCUMENTS

| | | | |
|---|---|---|---|
| 1,737,343 | 11/1929 | Sensibar | 214/15 BE |
| 2,505,982 | 5/1950 | Meissner | 214/15 D |
| 3,384,248 | 5/1968 | Leitch et al. | 214/15 E X |
| 3,536,208 | 10/1970 | Maddex et al. | 214/15 E |
| 3,559,893 | 2/1971 | Gruben | 198/669 X |
| 3,604,574 | 9/1971 | Leitch | 214/15 E |

*Primary Examiner*—Frank E. Werner
*Attorney, Agent, or Firm*—Charles L. Schwab

[57] ABSTRACT

A self-unloading ship includes two longitudinal tunnels with conveyor belts below two rows of hoppers at the bottom of the holds which extend nearly from one end of the ship to the other for unloading bulk material such as coal, iron ore, gypsum or the like. During unloading, the hopper gates are opened and the bulk material on the starboard and port sides of the cargo holds flows by gravity through the open hoppers onto the tunnel belts. A central ridge of bulk material remaining on the bottom floor of the holds between the two rows of hoppers is moved to the hoppers by a wheeled reclaimer having oppositely pitched augers which split the central ridge of bulk material, moving one half to the starboard row of hoppers and one half to the port row of hoppers. The reclaimer includes a power driven, endless chain harrow which drags down the central ridge of bulk material to prevent avalanching and an endless belt brush for cleaning the hold floors between the two rows of hoppers. The forward hold of the ship extends into the area of the bow having diminished width with the outboard walls of the forward hold converging to a reduced distance therebetween. Such ship construction (which affords increased capacity) is possible because of the use of two laterally spaced rows of hoppers and a central reclaimer for clearing bulk material from the floor between the hoppers. The inclined surfaces of the holds and their hoppers may be lined with a smooth plastic or similar material to improve the gravity flow of bulk material from the holds.

8 Claims, 6 Drawing Figures

SELF-UNLOADING SHIP WITH TWO TUNNEL BELTS AND A CENTRAL RECLAIMER

BACKGROUND OF THE INVENTION

Various means have been employed to remove bulk material from the holds of a self-unloading ship. One such prior art arrangement is shown in Canadian patent No. 867,178 (and in corresponding U.S. Pat. No. 3,604,574) issued to John D. Leitch on Mar. 30, 1971 for Apparatus for Unloading Bulk Material from a Storage Enclosure, such device being an improvement over the apparatus shown in Canadian patent No. 877,127 (and in corresponding U.S. Pat. No. 3,384,248) issued Aug. 3, 1971 to Jack D. Leitch and Nolan H. Williams for a Ship Unloading System. In these prior art arrangements, bulk material is unloaded through a central row of hoppers at the bottom of the ship holds onto an endless belt in a single tunnel at the longitudinal center bottom area of the ship. The prior art reclaimers used in these prior art ship unloading systems are of a fixed lateral width and extend across the full width of the hold. Such reclaimers can operate only in the part of the ship in which the sidewalls of the holds are at least as wide as the reclaimer. In the usual bulk carrier, the ship's sides converge at the bow and the stern. In a ship designed to use the prior art reclaimer, the cargo hold sidewalls are spaced a uniform distance apart and little, if any, use is made of the converging wall bow and stern areas of the ship for cargo holds.

It is an object of this invention to maximize the load carrying capability of a ship by providing a forward cargo hold with forward converging sidewalls, two laterally spaced rows of hoppers and a reclaimer which will remove material from the floors between the rows of hoppers in the forward and other holds.

BRIEF DESCRIPTION OF THE INVENTION

A self-unloading bulk carrier ship is provided with a forward hold in the bow of the ship which has forwardly converging sidewalls. Two parallel rows of gated hoppers are provided for the holds of the ship and two endless belt conveyors are provided beneath the hopper gates for receiving bulk material flowing by gravity from the hoppers. The two endless belt conveyors convey material to the end of the ship where it can be elevated to the boom belt. In the vessel shown, the cross conveyors convey the bulk material to a belt elevator which moves the material upwardly to a boom mounted belt conveyor. The inclined walls of the holds and hoppers may have layers of plastic thereon to improve material flow. A reclaimer is provided for removing the remaining ridge of bulk material from the hold floors between the two parallel rows of hoppers. The reclaimer has a pair of oppositely pitched augers operable to split the ridge of material and move it in opposite directions to the hoppers thereby achieving a complete unloading of the ship. The reclaimer travels on wheels on the floors of the holds longitudinally of the ship and may pass through doors in the transverse walls dividing the holds if necessary. The reclaimer need only be slightly wider than the floor space between the hoppers to accomplish its purposes and thus can be used in holds of varying overall widths. This permits the interior of the ship to be more fully utilized for bulk cargo. The reclaimer includes an endless chain type harrow for pulling down the central ridge of material in front of the augers of the reclaimer and also includes an endless belt brush behind and parallel to the augers for sweeping the floor as the reclaimer moves from one end of the ship to the other.

It is an object of the present invention to provide a two tunnel bulk transport ship and centrally operating reclaimer wherein the cargo carrying capacity of the ship is maximized.

It is a further object of the present invention to provide a reclaimer which is substantially less than the maximum width of the ship's holds.

It is a further object of the present invention to provide a ship having a pair of parallel series of hoppers for unloading the holds, a pair of endless belt conveyors disposed below the hoppers and a reclaimer which operates on the floor between the two rows of hoppers.

It is a further object of the present invention to provide a ship and reclaimer as set forth in the previous object wherein the sidewalls of the holds are at a sufficiently steep inclination to insure material sliding from the sidewalls to the hoppers by gravity.

These and other objects and advantages of the present invention will be apparent from the description which follows.

BRIEF DESCRIPTION OF THE DRAWINGS

The present invention is incorporated in the structure shown in the drawings in which.

DETAILED DESCRIPTION OF THE DRAWINGS

Figure 1:
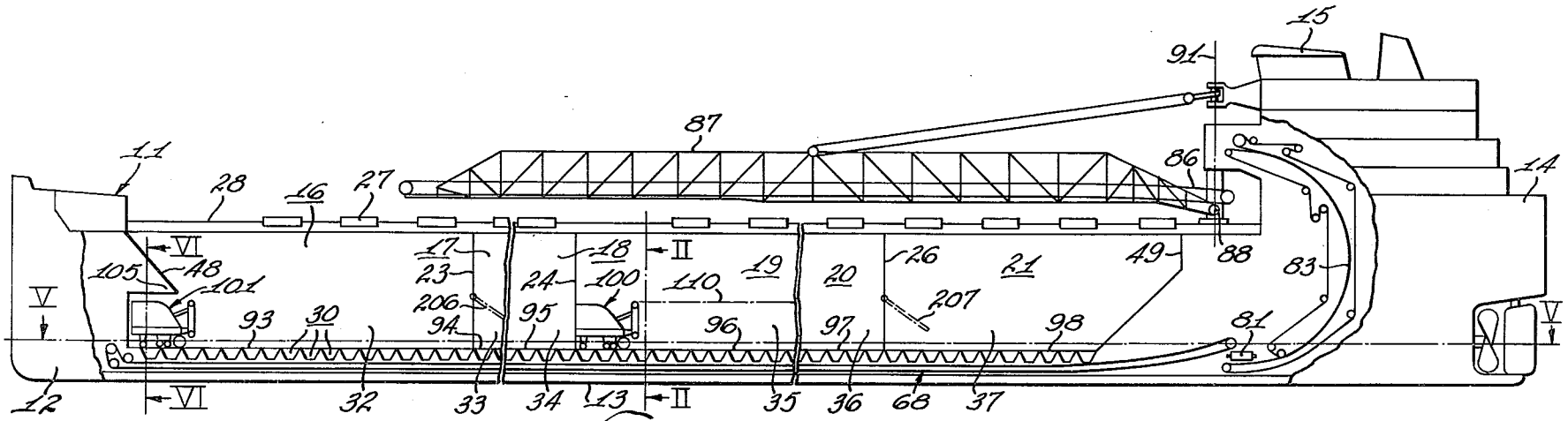
FIG. 1 is a side view of a self-unloading, bulk-material transport ship with parts broken away for illustration purposes.
Figure 2:
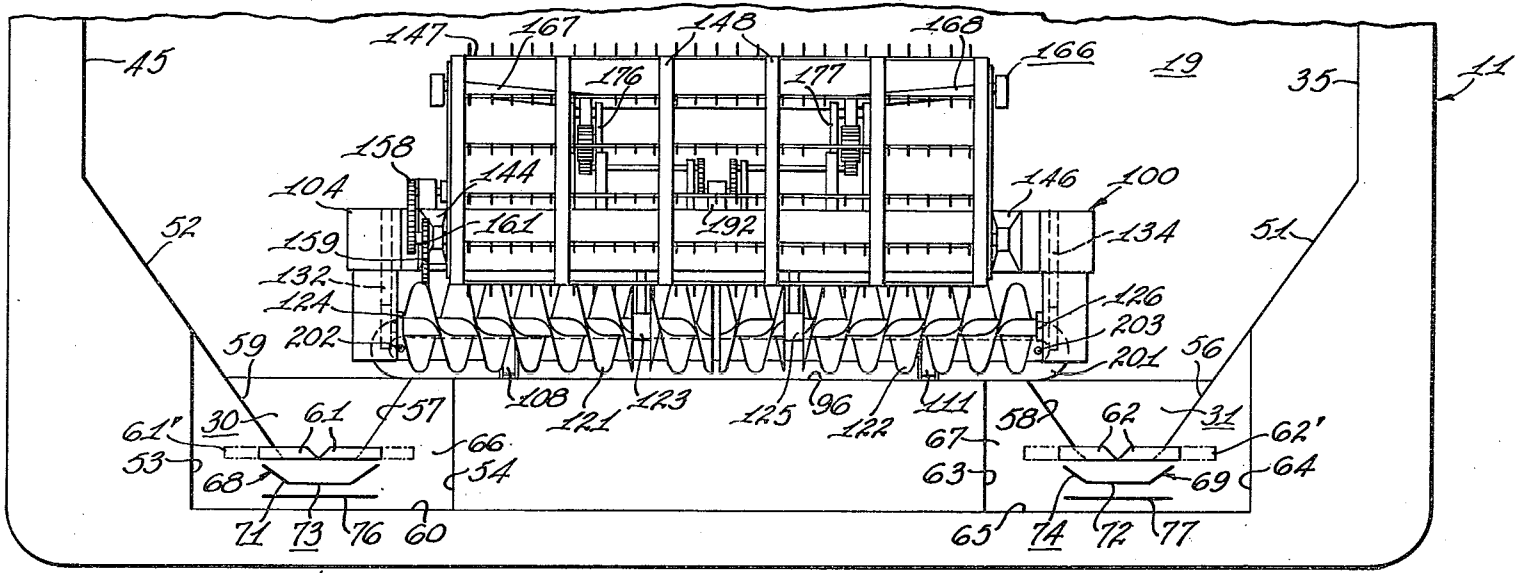
FIG. 2 is an enlarged section view taken along the line II—II in FIG. 1.
Figure 5:
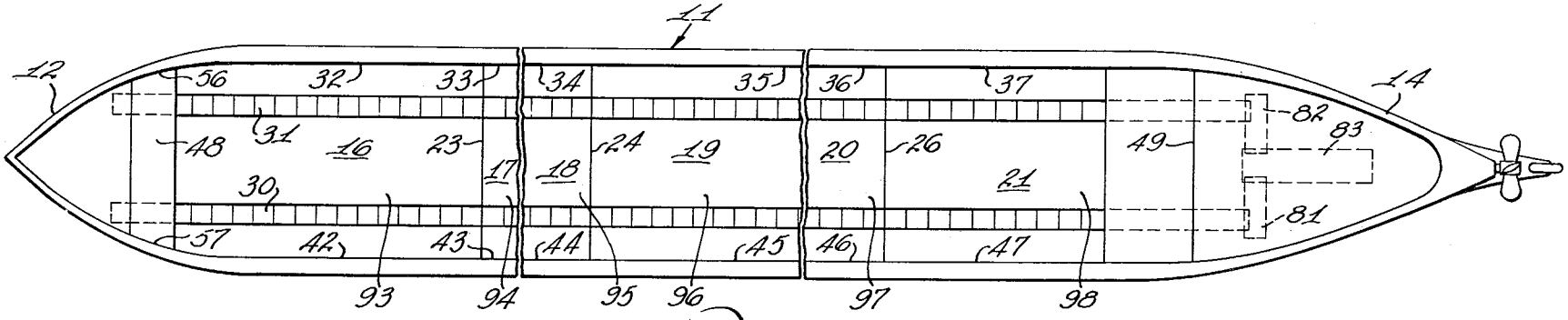
FIG. 5 is a section view taken along the line V—V in FIG. 1.

Referring to FIGS. 1, 2, 5 and 6, a self-unloading, bulk-material transport ship 11 includes a bow section 12, a mid-ship section 13 and a stern section 14 on which the bridge 15 is located. A plurality of holds 16, 17, 18, 19, 20, 21 are provided in the ship. The holds 16 and 17 are divided by a transverse wall or bulkhead 23, the holds 18 and 19 are divided by a bulkhead 24 and the holds 20 and 21 are divided by a bulkhead 26. The holds 16, 17, 18, 19, 20, 21 are filled through hatches 27 in the upper deck 28 and are emptied by two parallel rows of gated hoppers 30, 31 extending longitudinally of the ships. The holds 16-21 are defined by starboard sidewalls 32, 33, 34, 35, 36, 37 and port sidewalls 42, 43, 44, 45, 46, 47 by bulkheads 23, 24, 26 (and two other bulkheads, not shown, between holds 17 and 18 and between holds 19 and 20) and by fore wall 48 and aft wall 49. As shown in FIG. 2, the lower portions 51, 52 of the sidewalls 35, 45 of hold 19 slope upwardly at least 55 degrees from the horizon so that materials normally transported in bulk carriers will flow by gravity from the sidewalls to the hoppers during unloading. The sidewalls 56, 57, 58, 59 of the hoppers 30, 31 slope upwardly from horizontally opening gates 61, 62 at a 55 degree angle to the horizon. The hopper sidewall 56 is a continuation of and coplanar with sidewall portion 51 and the hopper sidewall 59 is a continuation of and coplanar with wall portion 52. The fore and aft walls of each hopper also slope at 55° to the horizon. In order to insure gravity unloading of bulk materials having a particularly steep angle of repose (those materials having poor gravity flow characteristics), sheets of smooth surface polyethylene or similar materials may be fixed to the sloping sidewalls of the holds and hoppers. The surface of the polyethylene sheets has a lower coefficient of friction than the surface of the steel sidewalls of the holds and hoppers. The other holds of the ship have lower portions on their sidewalls similar to the lower portions 51, 52 of sidewalls 35, 45 of the hold 19, except in the case of forward hold 16, which has forwardly converging sidewalls 32, 42. As shown in FIG. 5, the upper parts 56, 57 of the sidewalls 32, 42 are curved toward one another to a closely adjacent position to the outboard sides of the hoppers 30, 31. In other words, the width of the hold 17 is reduced at its bow end.

The space between the sidewalls of the holds and the hull of the ship is used for ballast compartments. Beneath the two parallel rows of hoppers 30, 31, there are walls 53, 54, 60, 63, 64, 65 defining a pair of longitudinally extending parallel tunnels 66, 67 in which a pair of endless belt conveyors 68, 69 are operatively disposed. When the gates 61 and 62 are opened, the bulk material in the associated hold will flow onto the upper working runs 71, 72 of the endless belts 73, 74, which are supported by conventional troughing rolls, not shown. The return runs 76, 77 of the belts 73, 74 are disposed below the working runs 71, 72. As shown in FIGS. 1 and 5, the tunnel conveyors 68, 69 deposit bulk material on a pair of short, transversely disposed cross conveyors 81, 82 which in turn deposit bulk material on the loading end of a belt elevator 83. The belt elevator 83 lifts the bulk material to its upper discharge end where the material is deposited onto an endless belt conveyor 86 supported on a boom 87. The boom 87 can be raised and lowered by pivoting about a horizontal axis 88 and can be swung to either side of the ship about a vertical axis 91.

Figure 6:
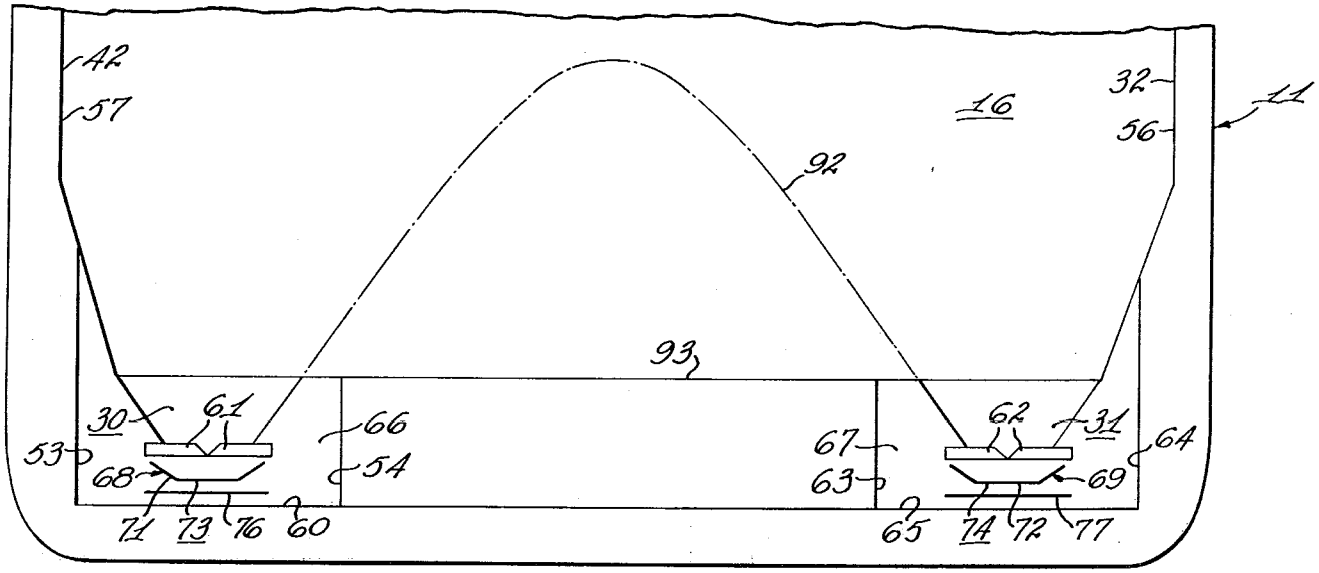
FIG. 6 is an enlarged section view taken along the line VI—VI in FIG. 1 but omitting the reclaimer.

During a ship unloading operation, the bulk material will flow by gravity through the open gates unto the endless belt conveyors 68, 69; however, a central ridge of bulk material, having a cross-sectional shape similar to that illustrated by dash line 92 in FIG. 6, will remain on the bottom floors 93, 94, 95, 96, 97, 98 of the holds. In order to remove the central ridge of bulk material from the bottom floors 93–97, which are substantially coplanar to form a continuous floor, a pair of identical reclaimers 100, 101 are provided. Only reclaimer 100 will be described in detail. Neither reclaimer is buried in the transported bulk material. Reclaimer 101, in its stored position shown in FIG. 1, is disposed beneath an overhang 105. The hold 19 in which reclaimer 100 is stored during transport is only filled with bulk material to broken line 110 and thus it is not "buried." Light loading of the central holds of long, bulk-handling ship is customary in order to reduce the risk of ship breakup in rough sea conditions.

Figure 4:
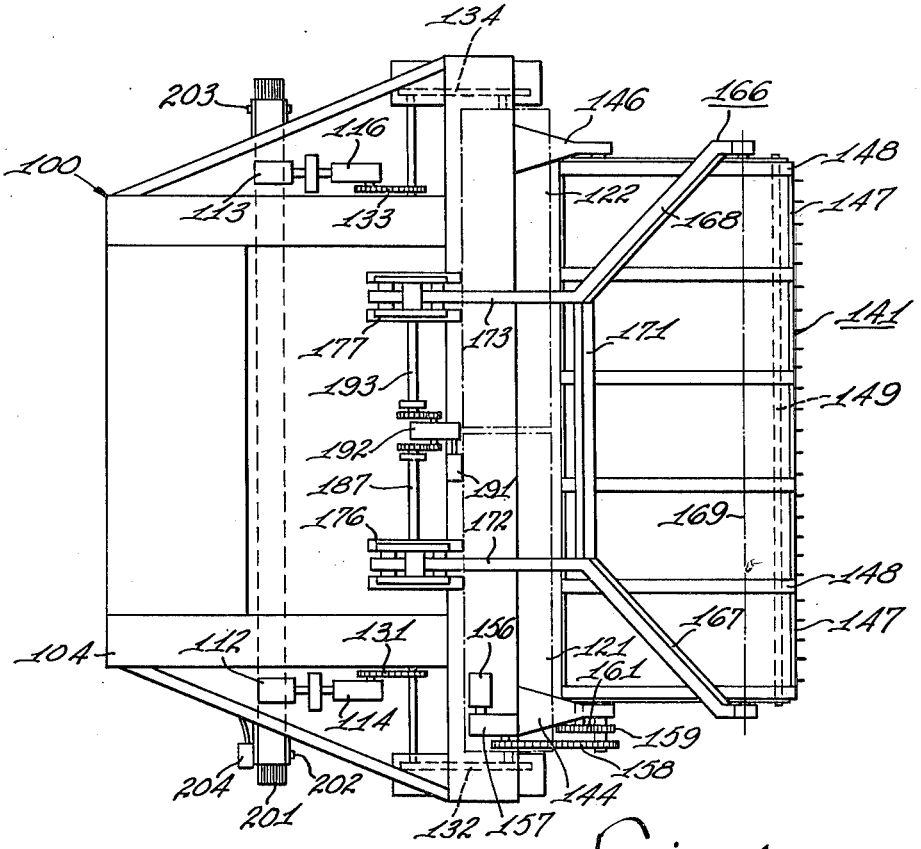
FIG. 4 is a top view of the reclaimer shown in FIG. 3.
Figure 3:
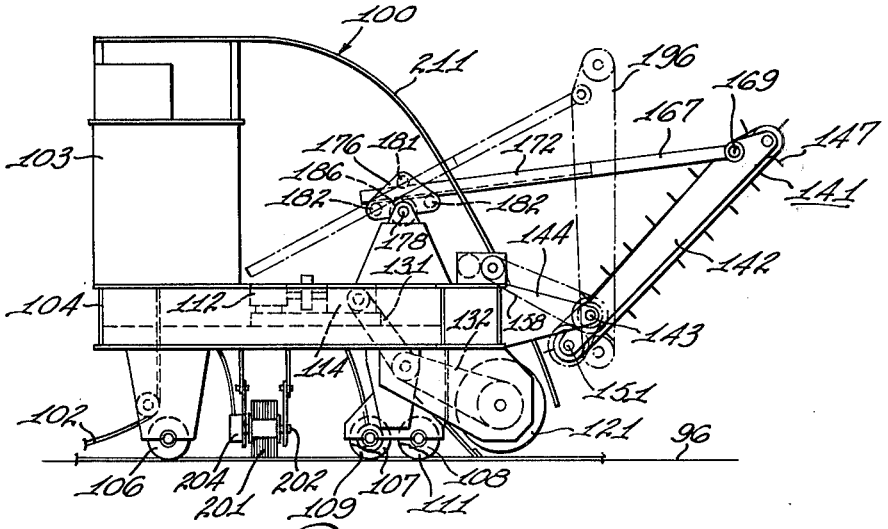
FIG. 3 is a side view of the reclaimer shown in FIG. 2.

Referring particularly to FIGS. 2, 3 and 4, the reclaimer 100 is powered and controlled by way of a flexible conduit 102 carrying electric control and power supply leads (not shown). The controls for the various motors on the reclaimer are housed in a control room 103 on the rear of a main frame 104. The rear of the main frame 104 is supported by a trailing wheel 106 and the front of the main frame is supported by tandem wheels 107, 108 at one lateral side and by tandem wheels 109, 111 at the other lateral side. The wheels 107, 109 are driven by hydraulic motors (not shown).

Oppositely pitched augers 121, 122 are rotatably mounted on the main frame 104 by bearings 123, 124, 125, 126 and are separately driven by electric motors 112, 113 by way of speed reducers 114, 116 and power trains including sprockets and chains 131, 132, 133, 134. The augers 121, 122 rotate in a clockwise direction as viewed in FIG. 3 so that the oppositely pitched flights of the augers split the bulk material residing on the floor and move substantially all of it in opposite directions from a central position on the floor 96 to the hoppers 30, 31. As shown in FIGS. 2 and 4, the inboard ends of the flights of the augers 121, 122 are in close, axial confronting relation to one another. In order to pull down the bulk material in front of the reclaimer 100, a harrow 141 is provided. The harrow 141 includes a frame 142 pivotally mounted near a bottom on its tranverse pivot axis 143 to the forwardly extending arms 144, 146 of the main frame 104. Transverse slats 147 of the harrow 141 are secured to endless belt link type chains 148 which are carried by sprockets on shafts 149, 151 at opposite upper and lower ends of the harrow 141. The shaft 151 is driven by an electric motor 156 by way of a speed reducer 157, link chain 158 and meshing gears 159, 161. The pivotal position of harrow 141 about the transverse axis 143 is controlled by a tilt brace 166 having a pair of arms 167, 168 with forward ends pivotally connected on a transverse axis 169 to the frame 142 of the harrow 141. The arms 167, 168 are rigidly interconnected by a transverse member 171 and the tilt brace 166 includes rearwardly extending legs 172, 173 which have spur teeth formed on the bottom sides thereof to form rack gears. The legs 172, 173 extend rearwardly through a pair of saddles 176, 177 which are pivotally mounted on the main frame on a transverse axis 178. The saddle 176 includes an upper roller 181 and two lower rollers 182. The leg 172 is disposed between the upper roller 181 and the lower rollers 182 and the teeth formed on the bottom of the leg 172 mesh with a gear 186 secured for rotation with a shaft 187. The shaft 187 is driven by an electric motor 191 by way of a speed reducer 192. Another drive shaft 193 is also driven by the speed reducer 192. It carries a gear which meshes with spur gear teeth formed on the bottom side of leg 173 in the same manner that gear 186 meshes with the teeth on the under side of leg 172. Thus, when the electric motor 191 is driven in one direction, the harrow will be raised as for instance to the position shown by broken lines 196 in FIG. 3. When the electric motor 191 is driven in the opposite direction the harrow will be swung vertically to its forwardly inclined position shown in solid lines in FIGS. 3 and 4. An endless belt bristle brush 201 is mounted on rollers supported on shafts 202, 203 and the shaft 202 is selectively driven by a hydraulic motor 204. The endless belt brush 201 is operative to clean the floor of any material left by the augers 121, 122 by sweeping it into either hoppers 30 or hoppers 31, depending on which direction the motor 204 is rotated. It will be noted that the upper extremities of the hoppers 30, 31 are at the same elevation as the adjacent floors 93–98 of the holds. In other words, the upper lips of the hoppers 30, 31 do not extend above the floors of the holds and thus the elevation of the floors is at least as high as the hoppers.

SHIP UNLOADING OPERATION

After the ship has docked and the unloading boom 87 has been positioned to permit discharge of bulk material to a desired point on shore, the gates 61, 62 may be selectively shifted from their closed positions to their open positions shown by dash lines 61', 62' to permit gravity discharge of the transported bulk material onto the belt conveyors 68, 69 in the tunnels 66, 67. When gravity flow of bulk material ceases, the reclaimers 100, 101 may then be activated individually or simultaneously to proceed toward the rear of the ship (which is in the reclaimers' forward direction). The harrows will be pivoted forwardly from their upright positions, as shown in FIG. 1, to a position approximately that of FIGS. 3 and 4 and the hydraulic motors, not shown, will be actuated to rotate the drive wheels to cause movement of the reclaimers toward the rear of the ship. As the reclaimer 100 moves in its forward direction toward the rear of the ship, the rotating augers split the ridge of residual bulk material and move it in opposite lateral or outboard direction to the hoppers 30, 31. At the same time, the harrow 141 is operated to pull the material toward the augers, thus avoiding tunneling and avalanching. Any bulk material not moved laterally by the augers 121, 122 is swept to one of the rows of hoppers 30, 31 by the endless brush 201 thereby effecting a clean unloading operation. If transverse walls are required, doors 206, 207 are provided in the transverse walls 23, 26 which may be opened to permit the reclaimers 100, 101 to pass from one hold to another. The reclaimers 100, 101 may be provided with a protective cover 211, shown only in FIG. 3.

In summary, this invention provides a bulk material self-unloading ship having a pair of longitudinal unloading tunnels with endless belts disposed therein and a flat floor area between two rows of unloading hoppers which is unloaded of material, not otherwise flowing by gravity to the hoppers, by one or more reclaimers which move in a longitudinal direction on the floor. Since the reclaimers need only be about the width of the floor between the rows of hoppers, rather than the width of the holds, the forward hold may extend into the bow end of the ship and include forwardly converging sidewalls.

The embodiments of the invention in which an exclusive property or privilege is claimed are defined as follows:

1. In a self-unloading ship for transporting bulk material, a cargo carrying mid-ship section between the bow and stern of said ship including walls defining two substantially parallel rows of hoppers in the bottom of said mid-ship section in laterally spaced relation to one another, and a flat floor between said rows of hoppers, the elevation of said floor being at least as high as said hoppers, gates at the bottom of said hoppers shiftable between closed and open positions, walls defining a tunnel below each of said rows of hoppers, an endless belt conveyor in each of said tunnels, each conveyor having an endless belt with a working run disposed below the gates of the associated row of hoppers, said conveyors being substantially parallel to one another.

a vehicular reclaimer supported on said floor by a plurality of wheels and adapted to operate in a fore and aft direction, said reclaimer being slightly wider than said floor and substantially narrower than said mid-ship section and including auger means rotatable about a transverse axis including oppositely pitched flights for splitting bulk material resting on said floor and simultaneously moving it in opposite lateral outboard directions to said rows of hoppers and power means for selectively moving said reclaimer in said fore and aft directions.

2. The combination of claim 1 wherein said forward portion of said mid-ship section has outboard walls which include generally vertical wall portions which converge inwardly at their bow ends.

3. The combination of claim 1 and further comprising a horizontally swingable boom mounted at the stern end of said ship including an endless belt conveyor and a belt elevator at said stern end operable to elevate material

4. The combination of claim 1 wherein said mid-ship section includes vertical transverse walls separating it into holds and wherein at least one of said transverse walls includes a door shiftable between closed and open positions said door in its open position permitting movement of said reclaimer therethrough.

5. The combination of claim 1 wherein said mid-ship section includes outboard walls which include lower portions which are disposed at an angle to the horizontal of at least 55°.

6. The combination of claim 5 wherein said lower portions have a thin layer of plastic material thereon to facilitate sliding of material to said hoppers.

7. The combination of claim 5 wherein said hoppers have laterally outer walls contiguous to and sloping at the same angle as said lower portions of said outboard walls of said holds whereby said laterally outer walls of said hoppers are coplanar with and are in effect a downward extension of said lower portions of said outboard walls.

8. The reclaimer of claim 1 wherein said auger means comprises two augers having oppositely pitched flights whose inboard ends are in close, axial confronting relation to one another.

* * * * *

UNITED STATES PATENT OFFICE

CERTIFICATE OF CORRECTION

Patent No. 4,072,238 Dated February 7, 1978

Inventor(s) Warren R. Vaughan

It is certified that error appears in the above-identified patent and that said Letters Patent are hereby corrected as shown below:

Column 6, line 33, after "rial" --- conveyed by said endless conveyors in said tunnels to said endless conveyor on said boom. --- should be inserted.

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*